US010653223B2

(12) United States Patent
Denoon

(10) Patent No.: US 10,653,223 B2
(45) Date of Patent: May 19, 2020

(54) HAIR BRAIDING KIT

(71) Applicant: Emalia Denoon, Havre de Grace, MD (US)

(72) Inventor: Emalia Denoon, Havre de Grace, MD (US)

( * ) Notice: Subject to any disclaimer, the term of this patent is extended or adjusted under 35 U.S.C. 154(b) by 467 days.

(21) Appl. No.: 15/606,722

(22) Filed: May 26, 2017

(65) Prior Publication Data

US 2018/0338594 A1 Nov. 29, 2018

(51) Int. Cl.

| | |
|---|---|
| ***A63F 9/24*** | (2006.01) |
| ***A45D 2/00*** | (2006.01) |
| ***A45D 8/34*** | (2006.01) |
| ***A45D 8/00*** | (2006.01) |

(52) U.S. Cl.

CPC ..... *A45D 2/00* (2013.01); *A45D 8/00* (2013.01); *A45D 8/34* (2013.01); *A45D 2002/003* (2013.01); *A45D 2002/005* (2013.01); *A45D 2008/002* (2013.01)

(58) Field of Classification Search

CPC ..... A45D 2002/003; A45D 2002/005; A45D 2008/002; A45D 2/00; A45D 8/00; A45D 8/34

See application file for complete search history.

(56) References Cited

U.S. PATENT DOCUMENTS

| | | | | |
|---|---|---|---|---|
| 3,930,331 | A * | 1/1976 | Simeone | A63H 3/02 446/369 |
| 4,017,984 | A * | 4/1977 | Bonfigli | G09B 19/0076 434/260 |
| 4,685,893 | A * | 8/1987 | Perkitny | A63H 3/52 132/201 |
| 5,590,668 | A | 1/1997 | Macy | |
| 5,896,863 | A | 4/1999 | Smith | |
| 6,352,048 | B1 * | 3/2002 | Scott | B42D 9/004 116/237 |
| 8,555,898 | B1 | 10/2013 | Byrd | |
| 9,156,649 | B1 * | 10/2015 | Torosian | B65H 69/04 |

OTHER PUBLICATIONS

Kelly, "How to French Braid", Apr. 14, 2011, hairdohow2.blogspot.com, pp. 1-5, at http://hairdohow2.blogspot.com/2011/04/lesson-44-french-braid-part-basic.html (last visited Oct. 31, 2019). (Year: 2011).*

* cited by examiner

*Primary Examiner* — Steve Rowland

(74) *Attorney, Agent, or Firm* — Dunlap Bennett & Ludwig PLLC

(57) ABSTRACT

A hair braiding kit. The hair braiding kit includes a base mat and at least a first hair attachment. The base mat includes an upper surface, a lower surface and an outer edge. The first hair attachment includes a first support protruding from the upper surface of the base mat. The first hair attachment further includes a plurality of strands each having a first end, a second end and a unique identifier. The first end of each of the strands is attached to the first support.

11 Claims, 4 Drawing Sheets

HAIR BRAIDING KIT

BACKGROUND OF THE INVENTION

The present invention relates to learning how to braid hair and, more particularly, to a hair braiding kit.

A braid is a complex structure or pattern formed by interlacing three or more strands of flexible material such as textile yarns, wire, or hair. Currently, hair braiding is taught on a mannequin head or a human being, both of which include a curved surface. The curved head makes learning how to braid difficult and time consuming.

As can be seen, there is a need for a flat surfaced hair braiding kit to teach students how to master braiding before moving to braiding on a curved surface or head.

SUMMARY OF THE INVENTION

In one aspect of the present invention, a hair braiding kit comprising of: a base mat with an upper surface, a lower surface and an outer edge; and a first hair attachment with: a first support protruding from the upper surface of the base mat; and a plurality of strands each comprising a first end, a second end and a unique identifier, wherein the first end is attached to the first support.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a flat surfaced hair braiding kit accompanied by teaching techniques specific to the hair braiding kit design. The present invention makes learning the art of braiding while mastering the techniques of finger placement and coordination easier and faster. An added benefit is that the braiding kit teaches users how to keep hands close to the foundation base without creating excess tension from pulling on a flat surface before proceeding to a curved head. The hair braiding kit allows users to learn to braid with or without extensions and apply the techniques learned to create inverted and French; plaits (individuals) and cornrows.

Figure 1:
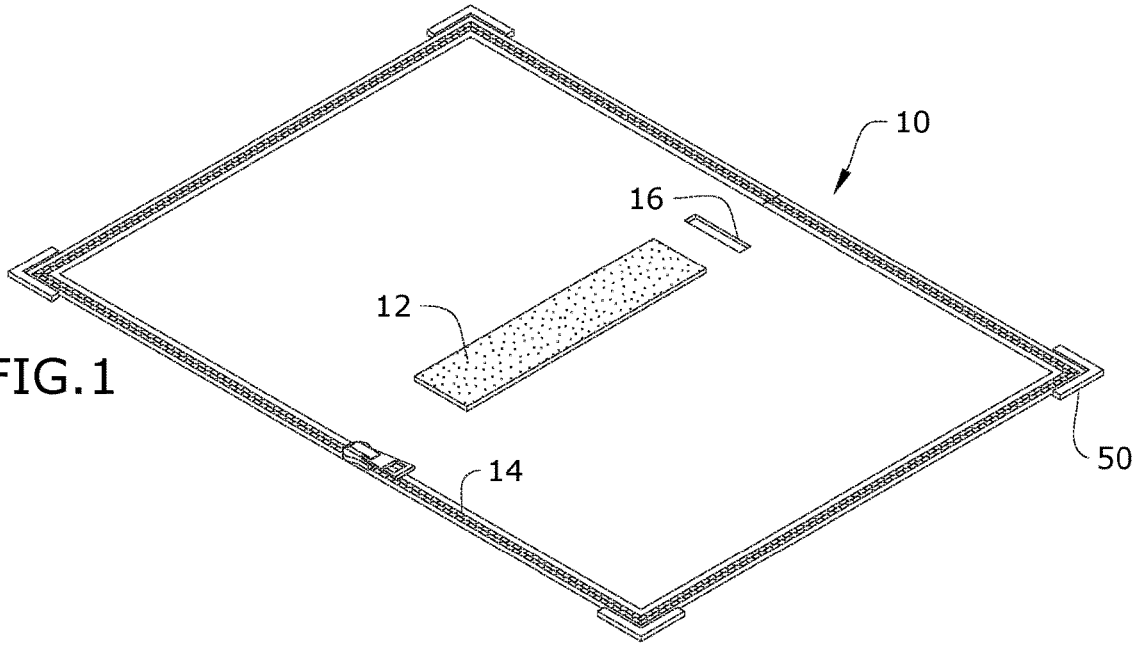
FIG. 1 is a perspective view of an embodiment of the present invention.
Figure 2:
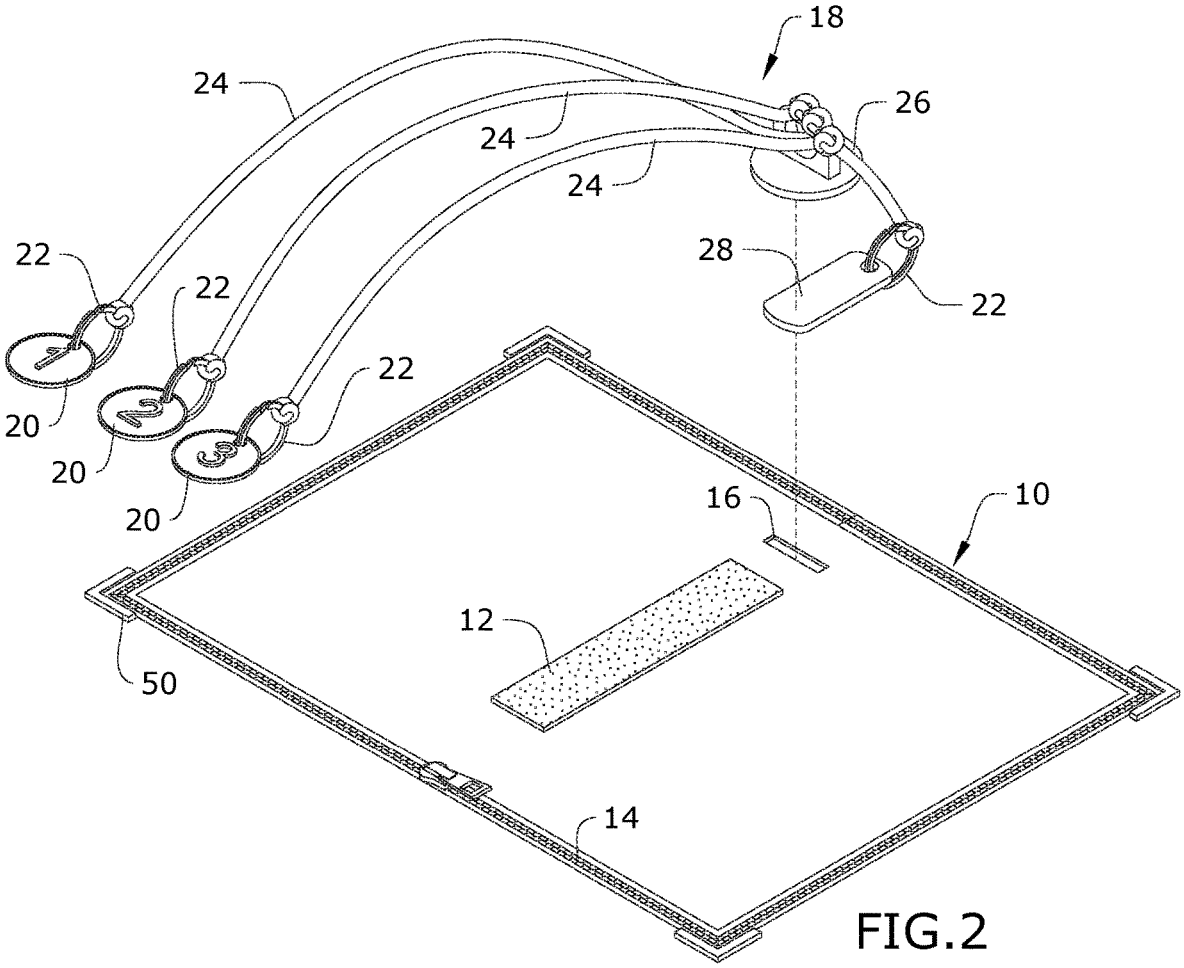
FIG. 2 is an exploded view of an embodiment of the present invention.

Referring to FIG. 1, the present invention includes a hair braiding kit. The hair braiding kit includes a base mat 10 and at least a first hair attachment 18. The base mat 10 includes an upper surface, a lower surface and an outer edge. The first hair attachment 18 includes a first support 26 protruding from the upper surface of the base mat 10. The first hair attachment 18 further includes a plurality of strands 24 each having a first end, a second end and a unique identifier 20. The first end of each of the strands 24 is attached to the first support 26.

The base mat 10 of the present invention may be made of plastic, flexible woven or biodegradable material. In certain embodiments, a zipper 14 may be disposed along the outer edge of the base mat 10. Therefore, the base mat 10 may act as a purse and may store all of the attachments 18, 32, 40, 44 within. When a user is ready to practice braiding, the zipper 14 may be unzipped and the base mat 10 may lay flat on a surface. A weight 50 may be secured to each corner of the base mat 10 to further stabilize the base mat 10 on the surface. The base mat 10 may further include a connector, such as a Velcro fastener 12, attached to the upper surface. The connector is not limited to a Velcro fastener 12, and may include any connector that may releasably retain an attachment 18, 32, 40, 44, such as clips, snaps, buckles, hook and fastener and the like.

In certain embodiments, the first support 26 may include a horizontal and a vertical portion extending from the horizontal portion. In such embodiments, the base mat 10 may include a slit 16 formed through the upper and lower surface. The vertical portion fits through the slit 16 and protrudes upward from the upper surface of the base mat 10. A flat piece 28 may be secured to the horizontal portion of the first support 26 by a strand and a ring 22. When in use, the flat piece 28 may be taped down to the support and prevent the first support 26 from being pulled through the slit 16.

Figure 3:
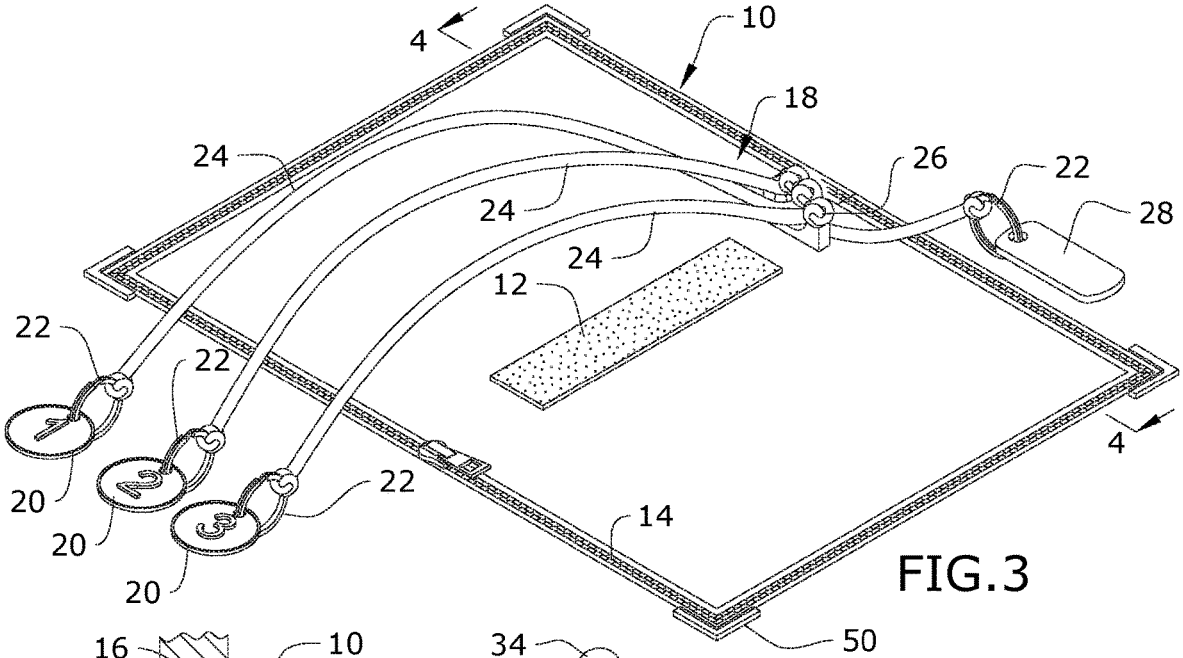
FIG. 3 is a perspective view of an embodiment of the present invention.
Figure 4:
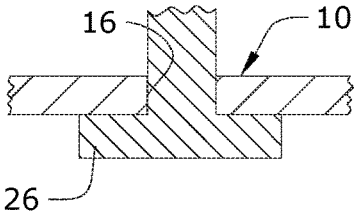
FIG. 4 is a section detail view of the present invention taken along line 4-4 in FIG. 3.
Figure 5:
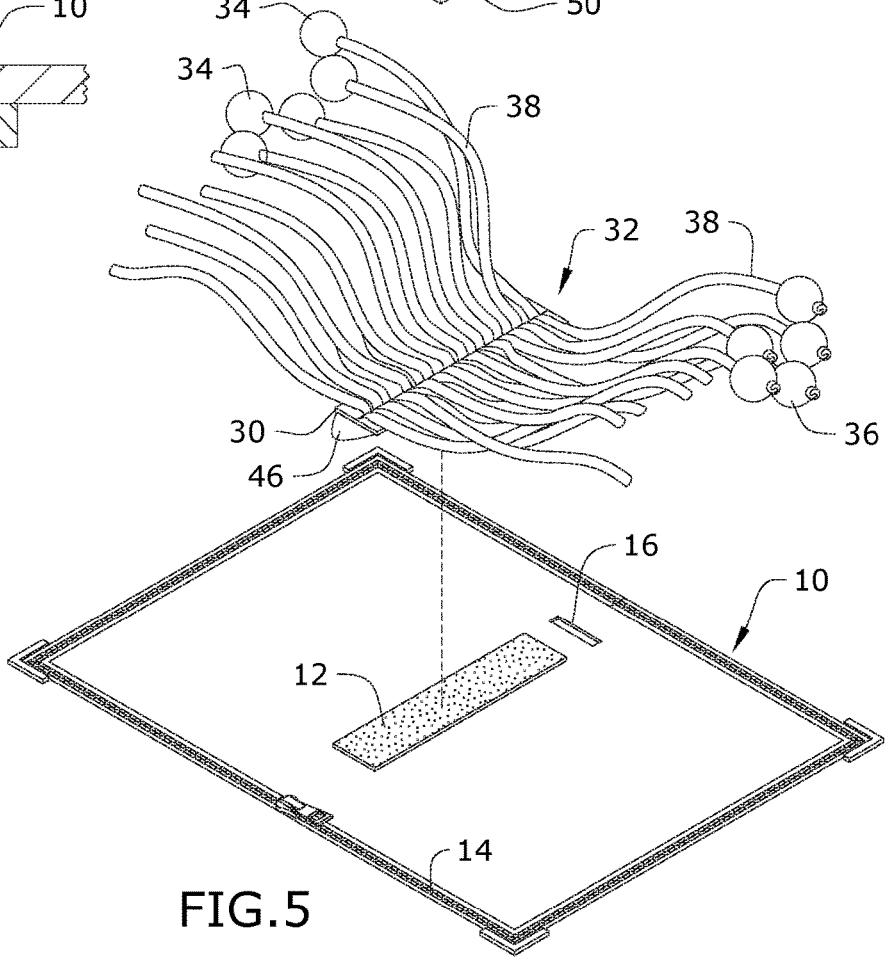
FIG. 5 is an exploded view of an embodiment of the present invention.
Figure 6:
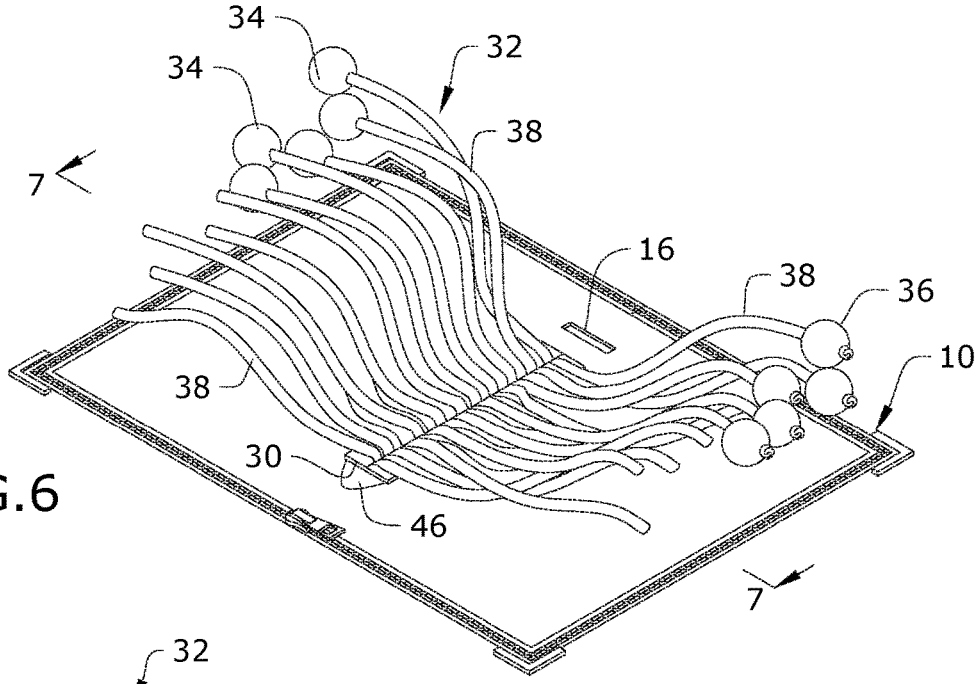
FIG. 6 is a perspective view of an embodiment of the present invention.
Figure 7:
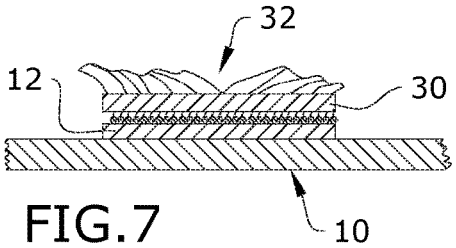
FIG. 7 is a section detail view of the present invention taken along line 7-7 in FIG. 6.
Figure 8:
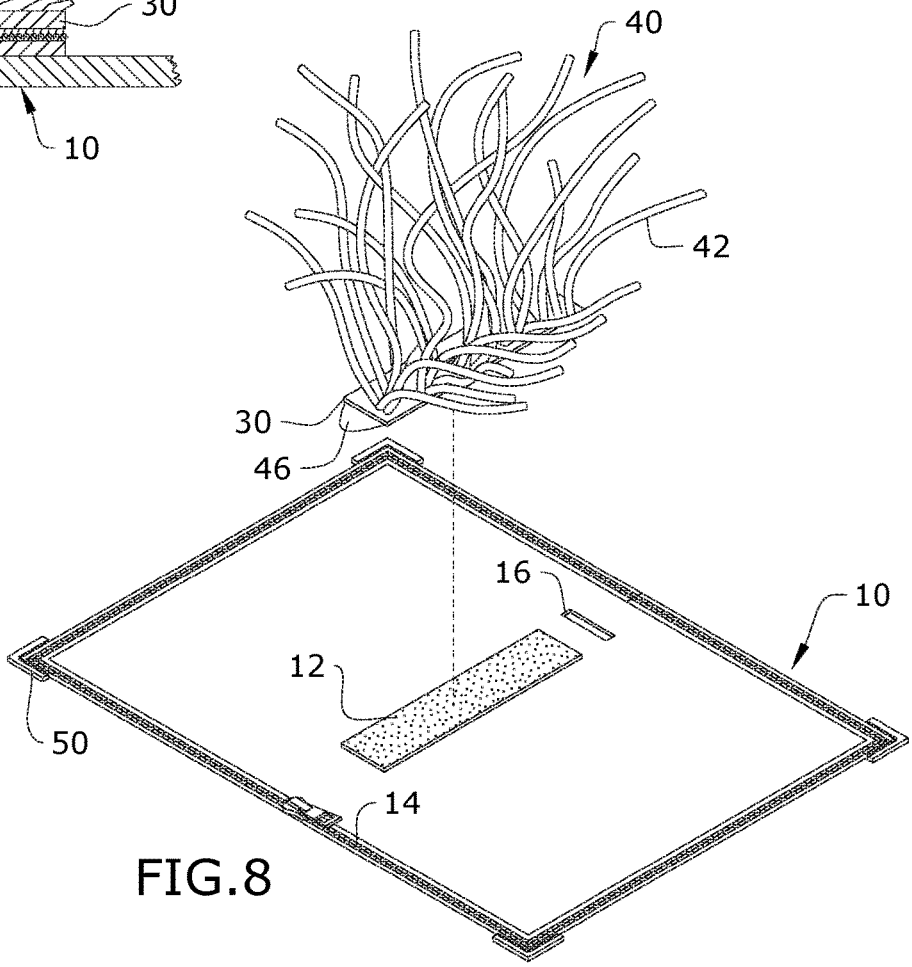
FIG. 8 is an exploded view of an embodiment of the present invention.

The plurality of strands 24 may include a first strand, a second strand and a third strand. The unique identifier 20 is at least one sequential indicator such as a printed number or letter and a color. As illustrated in FIG. 3, the unique identifier 20 is the printed number or letter. A first tag having a first number is secured to the second end of the first strand 24 by a ring 22. A second tag having a second number is secured to the second end of the second strand 24 by a ring 22. A third tag having a third number is secured to the second end of the third strand 24 by a ring 22. Therefore, an instructor may indicate the color and number of the strand 24 to use and the user may quickly find the strand 24 while learning how to braid.

The present invention may further include a second hair attachment 32. The second hair attachment 32 includes a strip 30 having the other of the Velcro fastener. A plurality of strands 38 are attached to the strip 30. The plurality of strands 38 include a first set of strands 38 disposed on one side of the strip 30 and a second set of strands 38 disposed on the other side of the strip 30. A plurality of first colored beads 34 are secured to each of the strands 38 of the first set and a plurality of second colored beads 36 are secured to each of the strands 38 of the second set.

The present invention may further include a third hair attachment 40. The third hair attachment 40 includes a strip 30 including the other of the Velcro fastener, and a plurality of strands 42 attached to the strip 30.

The second and third hair attachments 38, 40 releasably attach to the Velcro fastener 12 of the base mat 10. A user may practice forming corn rows using the second 32 and third attachments 40. Each of the second and third hair attachments 38, 40 may include a pull tab 46 extending from the strip 30 so that a user may easily remove the attachments 38, 40 from the base mat 10.

The present invention may further include a fourth attachment 44. The fourth attachment 44 includes a connector, such as the other of the Velcro fastener, that releasable connects with the Velcro fastener 12 of the base mat 10. The fourth attachment 44 includes a netted pocket. The netted pocket is a plurality of crisscrossing fibers, forming space therebetween. A curved oblong object 48 may be placed within the netted pocket. An advanced user may attach the fourth attachment 44 to the connector of the base mat 10. A rounded or oval shaped object 48 is placed inside the netted pocket. The advanced user may attach real or fake hair strands to the netted pocket and begin braiding the hair along the rounded or oval shaped object 48. The curved oblong object 48 replicates the curvature of the human head.

Figure 9:
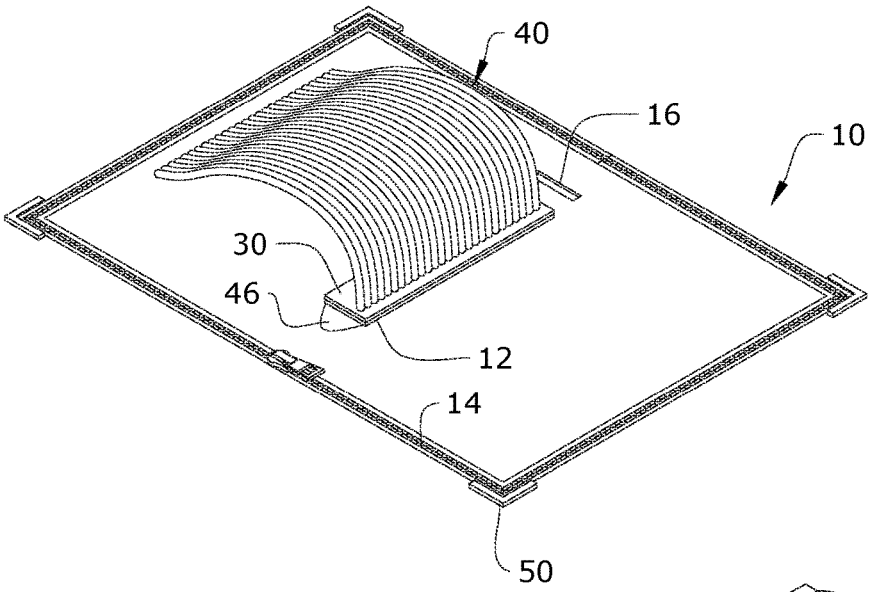
FIG. 9 is a perspective view of an embodiment of the present invention.
Figure 10:
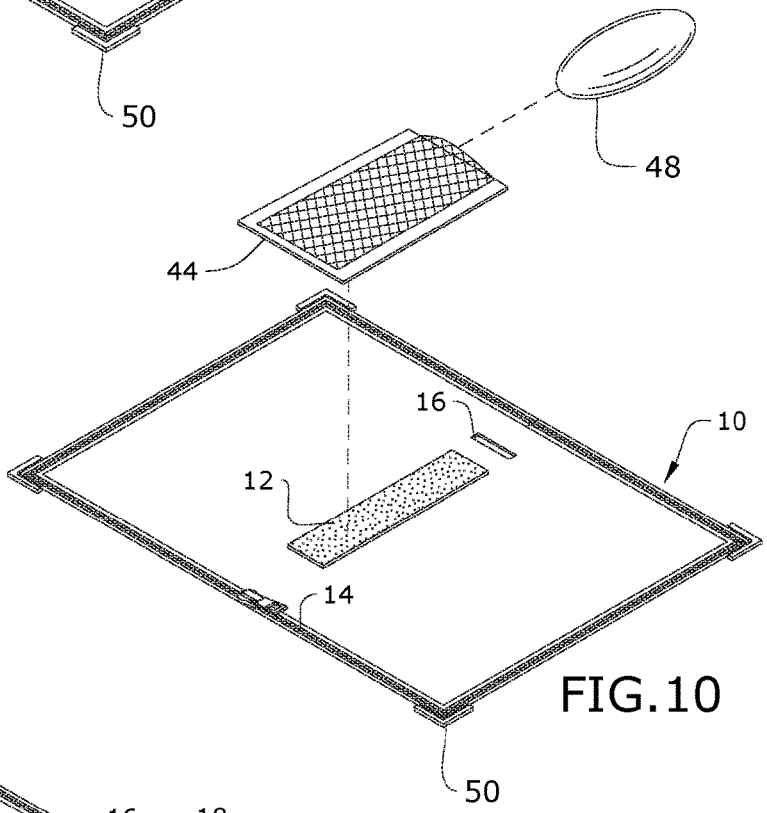
FIG. 10 is an exploded view of an embodiment of the present invention.
Figure 11:
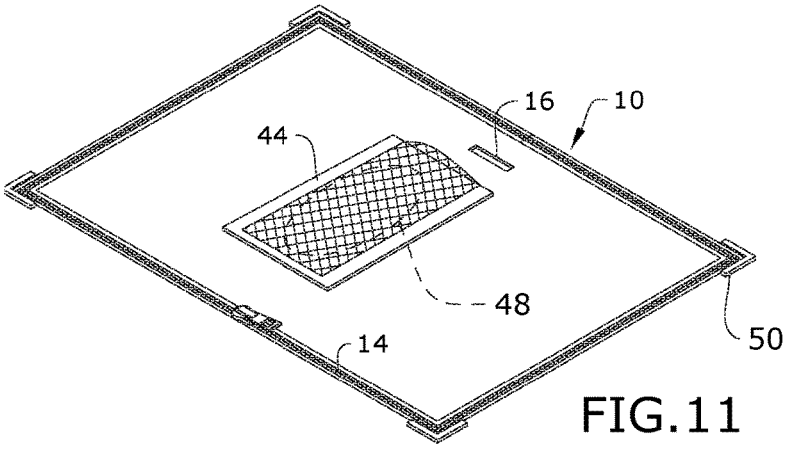
FIG. 11 is a perspective view of an embodiment of the present invention.

A method of using the present invention may include the following. The present invention includes a technique for teaching the basics of how to cornrow by pairing the unique identifiers 20 on strands 24 to hair attachment 32 using alternating beads from strands 38 to elongate the individual braid into a cornrow. The technique progresses to an intermediate step by removing the beads 34 and 36 from the strands 38. The strands 40 will be for an intermediate skilled user as there are no bead identifiers 34 and 36 however the unique identifiers 20 will remain in place as a guide to continue to remind the user of the next step in the cornrow process. As an advanced step, the strands 40 are untwisted and combed to blend and simulate human hair 40 in FIG. 9. The unique identifiers 20 can be used to remind the user of the next step, however the goal of each step is to develop user skill that will allow the user to cornrow without the need for any identifiers such as 20, 34, or 36.

It should be understood, of course, that the foregoing relates to exemplary embodiments of the invention and that modifications may be made without departing from the spirit and scope of the invention as set forth in the following claims.

What is claimed is:

1. A hair braiding kit comprising:

a base mat comprising of an upper surface, a lower surface and an outer edge; and a first hair attachment comprising:

a first support protruding from the upper surface of the base mat; and a plurality of strands each comprising a first end and a second end, wherein the first end is attached to the first support, and a plurality of tags, wherein each of the plurality of tags is coupled to the second end of a corresponding strand of the plurality of strands, wherein each of the plurality of tags comprises a unique identifier, wherein the unique identifier is at least one of a printed number and a printed letter.

2. The hair braiding kit of claim 1, wherein the plurality of strands comprises a first strand, a second strand and a third strand.

3. The hair braiding kit of claim 1, wherein the plurality of tags comprises a first tag secured to the second end of the first strand, a second tag secured to the second end of the second strand, and a third tag secured to the second end of the third strand.

4. The hair braiding kit of claim 1, wherein the first support comprises a horizontal portion and a vertical portion extending from the horizontal portion, wherein the base mat comprises a slit and the vertical portion fits through the slit.

5. The hair braiding kit of claim 1, further comprising one of a velcro fastener attached to the upper surface of the base.

6. The hair braiding kit of claim 5, further comprising a second hair attachment comprising a strip comprising the other of the velcro fastener, and a plurality of strands attached to the strip, wherein the plurality of strands comprise a first set of strands disposed on one side of the strip wherein a plurality of first colored beads are secured to each of the strands of the first set and a second set of strands disposed on an opposing side of the strip, wherein a plurality of second colored beads are secured to each of the strands of the second set.

7. The hair braiding kit of claim 5, further comprising a third hair attachment comprising a strip comprising the other of the velcro fastener, and a plurality of strands attached to the strip.

8. The hair braiding kit of claim 1, further comprising a fourth attachment comprising a strip comprising the other of the velcro fastener, a netted pocket secured to the strip, and a rounded object disposed within the netted pocket.

9. The hair braiding kit of claim 1, further comprising a zipper disposed along the outer edge of the base mat.

10. A hair braiding kit comprising:

a base mat comprising of an upper surface, a lower surface and an outer edge; and a first hair attachment comprising:

a first support protruding from the upper surface of the base mat, the first support comprising a horizontal portion and a vertical portion extending from the horizontal portion, wherein the base mat comprises a slit and the vertical portion fits through the slit; and a plurality of strands each comprising a first end, a second end and a unique identifier, wherein the first end is attached to the first support.

11. A hair braiding kit comprising:

a base mat comprising of an upper surface, a lower surface and an outer edge, wherein a zipper is disposed along the outer edge of the base mat; and a first hair attachment comprising:

a first support protruding from the upper surface of the base mat; and a plurality of strands each comprising a first end, a second end and a unique identifier, wherein the first end is attached to the first support.

* * * * *